US005580424A

United States Patent [19]

Snellman

[11] Patent Number: 5,580,424

[45] Date of Patent: Dec. 3, 1996

[54] APPARATUS AND METHOD FOR SEALING A SUCTION BOX OF A SUCTION ROLL IN A PAPER MACHINE

[75] Inventor: Jorma Snellman, Jyväskylä, Finland

[73] Assignee: Valmet Corporation, Helsinki, Finland

[21] Appl. No.: 206,502

[22] Filed: Mar. 4, 1994

[30] Foreign Application Priority Data

Nov. 5, 1993 [FI] Finland ..... 934909

[51] Int. Cl.[6] ..... D21F 3/10

[52] U.S. Cl. ..... 162/371; 162/369; 162/368; 162/370

[58] Field of Search ..... 162/371, 369, 162/368, 370; 277/34, 34.3, 103, 106, 105, 123, 181

[56] References Cited

U.S. PATENT DOCUMENTS

| | | | |
|---|---|---|---|
| 754,036 | 3/1904 | Andrews | 162/369 |
| 2,274,641 | 3/1942 | Abbott et al. | 162/371 |
| 2,649,719 | 8/1963 | Hornbostel | 162/371 |
| 3,737,139 | 6/1973 | Watts | 251/1.2 |
| 3,802,961 | 4/1974 | Grass et al. | 162/371 |
| 4,058,435 | 11/1977 | Williams, Jr. | 162/371 |
| 4,915,787 | 4/1990 | Brangon et al. | 162/199 |
| 5,143,015 | 9/1992 | Lubitz et al. | 166/187 |

FOREIGN PATENT DOCUMENTS

| | | |
|---|---|---|
| 771973 | 1/1978 | Finland . |
| 76388 | 10/1984 | Finland . |
| 386700 | 5/1975 | Sweden . |

*Primary Examiner*—Donald E. Czaja
*Assistant Examiner*—Calvin Padgett
*Attorney, Agent, or Firm*—Steinberg, Raskin & Davidson, P.C.

[57] ABSTRACT

A sealing construction for a suction box of a suction roll in a paper machine and a method for sealing a suction roll in which a seal is arranged in a holder and loading members, preferably at least one loading hose, are arranged between the holder and the seal. The seal is pressed against an inner face of the roll mantle of the suction roll by the pressure of a medium that has been supplied into the loading hose. Locking devices are situated between the seal and the holder to lock the seal in a desired position.

23 Claims, 7 Drawing Sheets

APPARATUS AND METHOD FOR SEALING A SUCTION BOX OF A SUCTION ROLL IN A PAPER MACHINE

BACKGROUND OF THE INVENTION

The present invention relates to a sealing construction for a suction box of a suction roll in a paper machine and a method for sealing a vacuum space in a suction roll.

In the prior art, it is a problem that wear of the seals used in the suction rolls prevents the seals from achieving longer intervals between servicing. In a conventional prior art construction, in order to produce an efficient and well sealed suction roll, the seals are pressed pneumatically against an inner face of the roll mantle of the roll. The compression force is constantly maintained and as a result, the seal is therefore worn quite rapidly.

OBJECTS AND SUMMARY OF THE INVENTION

It is an object of the present invention to provide a new and improved apparatus and method for sealing a suction box in a suction roll in which the seal has a longer interval between servicing than that required by the prior art constructions.

It is another object of the present invention to provide a new and improved seal for use in a suction roll which presents a novel efficient solution for avoiding wear of the seal.

Accordingly, in the present invention, a seal rib which acts to define an end of the suction box, is provided with locking means. The seal is first pressed against the roll mantle of the suction roll by loading means. After negative pressure (suction) has developed in the suction box, the seal is locked in its holder. At the same time or any time thereafter, the pressure can be discharged from the loading means of the seal, i.e., the loading force can be removed. When an arrangement in accordance with the present invention is used, even the water lubrication, currently used in conjunction with conventional seal ribs, can be omitted. In a preferred embodiment of the present invention, the seals may be provided with chamfering, which permits a gradual equalization of the pressures in the perforations in the suction roll as the perforations in the roll depart from the zone of negative pressure during revolution of the suction roll.

The sealing construction in accordance with the present invention for a suction box of a suction roll in a paper machine comprises locking means arranged between the seal and the socket in which the seal is held and retained. The locking means serve to lock the seal in a desired position so that it is possible to remove the load from the loading means, e.g., loading hose, so as to minimize the wear of the seal, i.e., the loading means are inactive during the operation of the suction box.

In the method in accordance with the present invention for sealing a suction roll, the seal is locked in relation to its holder by locking means. A seal in accordance with the present invention is arranged on at least one edge of a vacuum space and preferably at both ends. The seal is pressed against an inner face of a roll mantle of the suction roll, and locked in a holder, e.g., after negative pressure has been generated in the vacuum space in the suction box. The seal may also be locked before or during the generation of the negative pressure in the suction box. Preferably, a part of the seal is pressed against an inner surface of the holder to thereby lock the seal in the holder. The seal may be arranged in an intermediate holder which is in turn arranged in the holder. The intermediate holder is then pressed against an inner surface of the holder to lock the seal in a secure position in the holder.

The locking of the seal may be achieved by arranging an inflatable loading hose between the seal and the holder, and directing compressed air into the loading hose to load the loading hose. The loading hose may be arranged between the intermediate holder and the holder in the embodiments wherein the intermediate holder is present. A spring can be arranged in the intermediate holder to press the seal in a direction against the inner face of the roll mantle of the suction roll.

The present invention will be described in the following with reference to preferred embodiments of the invention, which are illustrated in the figures in the accompanying drawings. However, the present invention is not confined to these embodiments alone.

BRIEF DESCRIPTION OF THE DRAWINGS

The following drawings are illustrative of embodiments of the invention and are not meant to limit the scope of the invention as encompassed by the claims.

FIGS. 3D and 3E show the use of a wedge-shaped locking piston wherein FIG. 3D illustrates a situation in which the loading is on but in which locking has not been carried out and FIG. 3E illustrates a situation in which the locking is on and in which the load has been removed from the seal.

DETAILED DESCRIPTION OF THE INVENTION

Figure 1A:
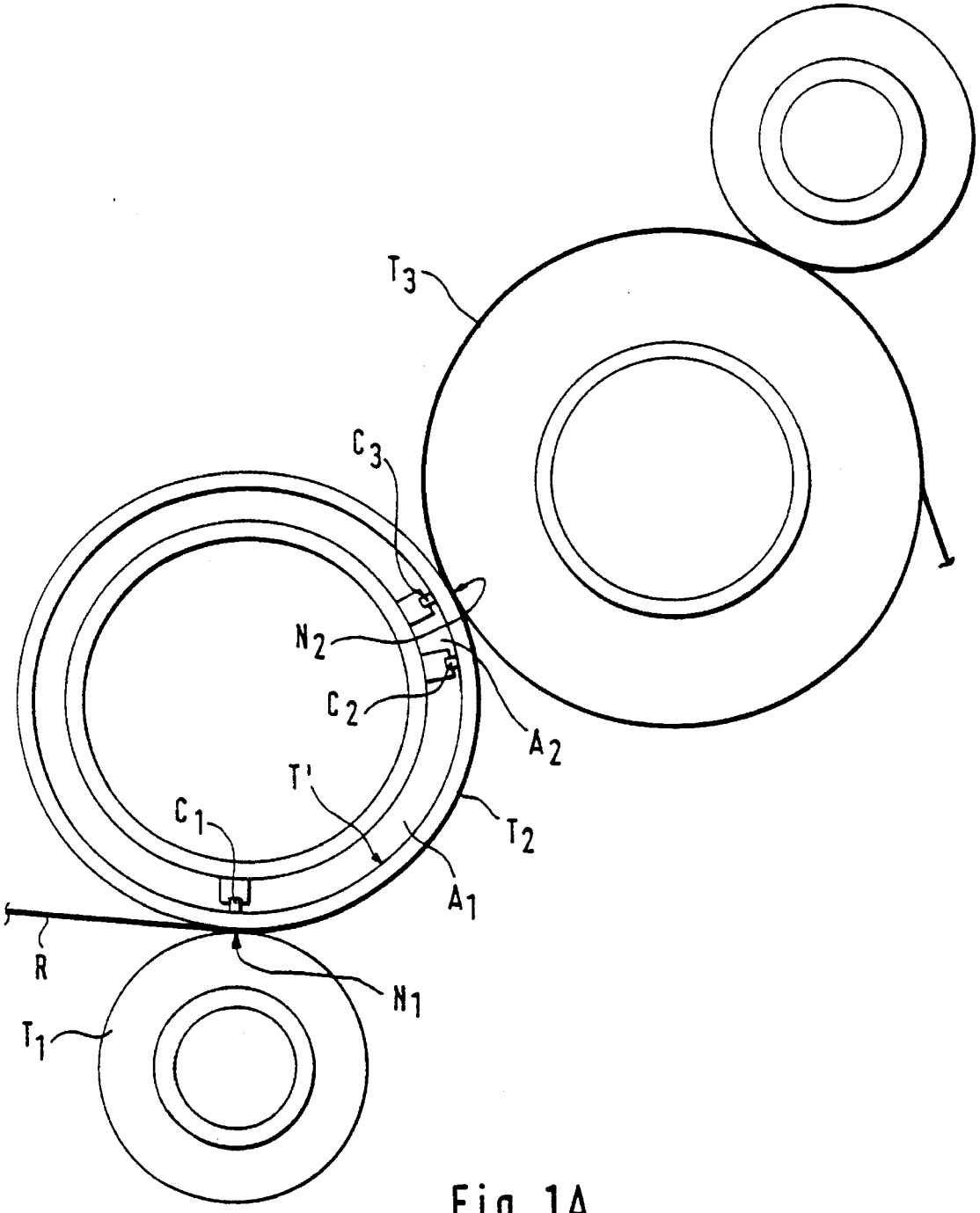
Fig. 1A PRIOR ART
FIG. 1A is an illustration of a suction roll in a paper machine which operates to remove water from the web.

Referring to the accompanying drawings in which like numerals refer to the same elements, FIG. 1A shows a prior art operation of a suction roll in a paper machine. A web R is passed through a nip $N_1$ formed between rolls $T_1$ and $T_2$ and then along a face of the roll $T_2$ into a nip $N_2$ formed between rolls $T_2$ and $T_3$. A vacuum chamber $A_1$ and a vacuum chamber $A_2$ are arranged in the interior of the roll $T_2$. The vacuum chamber $A_1$ is situated between seals $C_1$ and $C_2$, and the vacuum chamber $A_2$ is situated between seals $C_2$ and $C_3$. Water is sucked out of the web R into the vacuum chambers $A_1$,$A_2$. In this prior art operation, the seals $C_1$,$C_2$ and $C_3$ are constantly pressed against the inner face of a mantle T' of the roll $T_2$ by means of a force produced by loading means, e.g.,loading hoses.

Figure 1B:
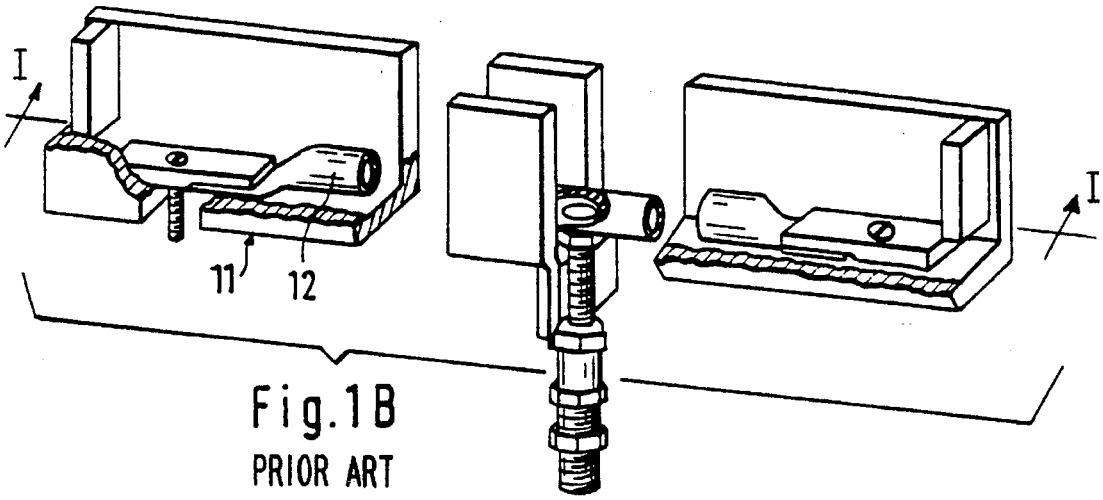
Fig.1B PRIOR ART
FIG. 1B shows a seal holder for a prior art sealing operation and a loading hose placed on the bottom of the holder.
Figure 1C:
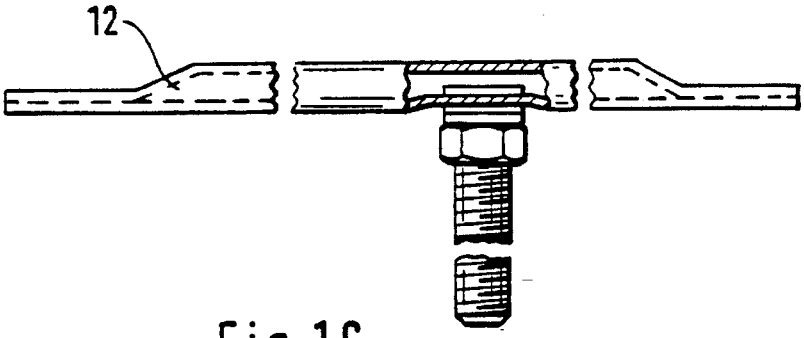
Fig 1C PRIOR ART
FIG. 1C is a sectional view taken along the line I—I in FIG. 1B.

FIG. 1B shows a prior art holder construction 11 for the seals $C_1$,$C_2$ and $C_3$ shown in FIG. 1A. Each of the seals (not shown in FIG. 1B) is pressed by a force, produced by means of pneumatic pressure generated in a loading hose 12, against an inner face $T_2$' of the roll mantle of the roll $T_2$. FIG. 1C is a sectional view taken along the line I—I in FIG. 1B. The seals are inserted into the holder 11 into a position immediately above the loading hose 12.

In the prior art sealing constructions shown in FIGS. 1A–1C, the seals $C_1$,$C_2$ and $C_3$ are constantly pressed by a force against the inner face of the roll mantle of the revolving roll. As a result of this constant pressure, the seals $C_1$,$C_2$ and $C_3$ are worn rapidly even if they are lubricated with water during the operation of the suction roll.

Figure 2:
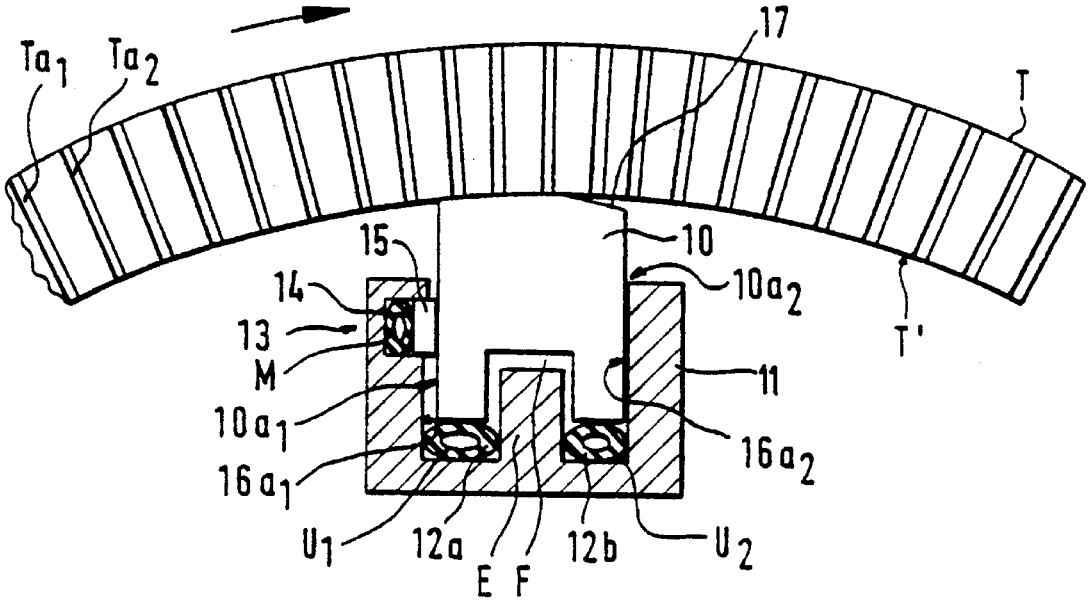
FIG. 2 shows a seal construction in accordance with the present invention comprising seal locking means and which is used in the method in accordance with the present invention.

FIG. 2 shows a sealing construction in accordance with the present invention for prevention of wear of the seal. As shown in FIG. 2, a seal 10 comprises loading hoses 12*a* and 12*b* in grooves $U_1$ and $U_2$ situated in a holder 11. By means of pneumatic pressure introduced into the loading hoses 12*a*,12*b*, the hoses 12*a*,12*b* are inflated in the space between the bottom of the seal 10 and the grooves $U_1$ and $U_2$ so that the seal 10 is pressed by means of the loading hose by force against an inner face T' of the roll mantle of the suction roll T. When the load is being applied in the hoses 12*a* and 12*b*, negative pressure is sucked into the space $A_1$ (as shown in the arrangement of FIG. 1), and after which the seal 10 is locked in its position in relation to its holder 11 by locking means 13. After the seal has been locked in a desired position, the pressure is removed from the loading hoses 12*a*,12*b* so that wear of the seals 10 is substantially eliminated. By means of the locking means or member 13, which is preferably a loading hose 14, the seal 10 is kept in a position in which adequate negative pressure is maintained in the vacuum space $A_1$ between the longitudinal seals placed at the edges of the suction box in the suction roll.

The locking of the seal 10 takes place so that the locking means 13 of the seal 10 are affected preferably by means of pneumatic pressure applied to a third loading hose 14 which displaces a locking piston 15. The piston 15 presses the seal 10 against an inside wall 16*a*$_2$ of the seal holder 11. The loading hose 14 and the connected piston 15 are placed in a groove M in the side wall 16*a*$_1$ in the holder 11 opposite from the side wall 16*a*$_2$ against which the seal 10 is pressed. As shown in FIG. 2, the seal is provided with a chamfering 17 at its edge. By means of the chamfering 17, the negative pressure in perforations $Ta_1$,$Ta_2$, . . . in the suction roll T is gradually equalized, and intensive disturbing noise associated with the equalization of the pressure as the perforations $Ta_1$,$Ta_2$, . . . in the roll T during the rotation of the roll from an area of negative pressure to an area of normal atmospheric pressure is substantially prevented.

Figure 3A:
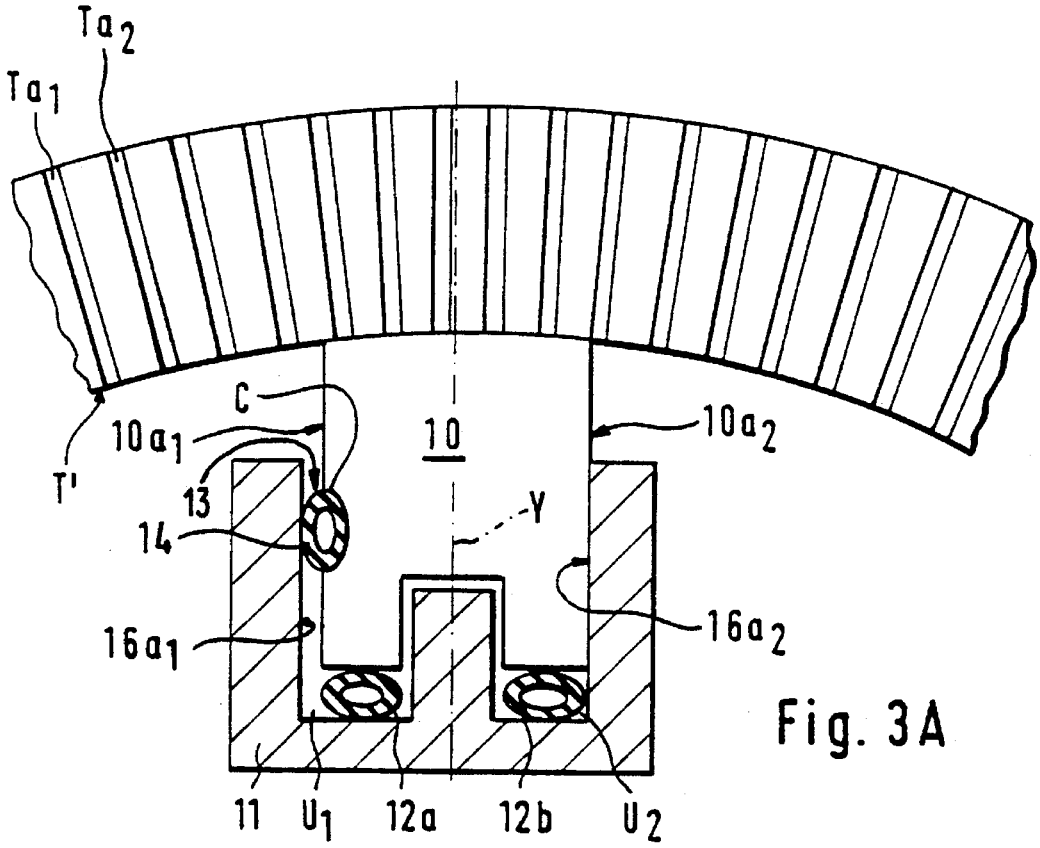
FIG. 3A shows a second embodiment of a seal construction in accordance with the present invention in which the locking is accomplished exclusively by means of a loading hose arranged in a longitudinal groove in the seal.

FIG. 3A shows an embodiment of the present invention in which the locking means 13 of the seal 10 comprise only a loading hose 14. The loading hose 14 is arranged in a groove C having a semi-circular cross-section and being formed in a side face 10*a*$_1$ of the seal 10. The seal is arranged to act between the wall 16*a*$_1$ of the holder 11 and a face C' of the groove C. When the loading pressure is directed into the hose 14, the seal 10 is pressed against the wall 16*a*$_2$ of the holder 11.

In the embodiments shown in both FIG. 2 and FIG. 3A, the holder comprises a guide projection E in the area of a central axis Y of the holder. The cross-sectional shape of the projection preferably corresponds to the shape of the groove F in the bottom of the seal. Loading hoses 12*a*,12*b* are arranged in spaces $U_1$ and $U_2$ formed between the guide projection E and the opposed side walls 16*a*$_1$,16*a*$_2$ of the holder.

Figure 3B:
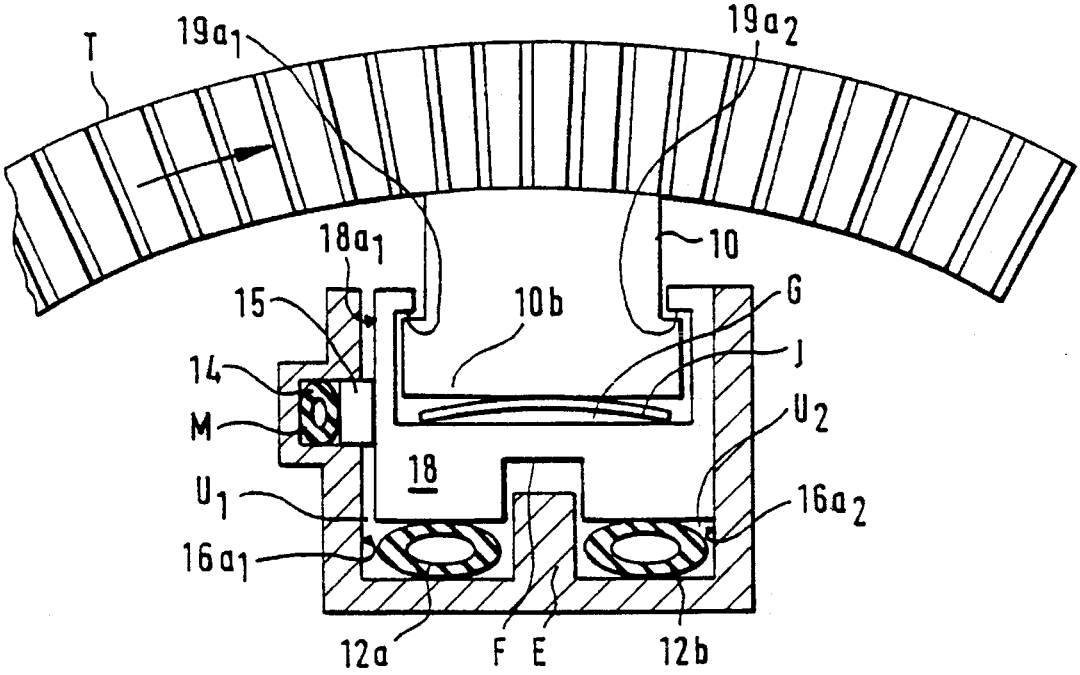
FIG. 3B shows a seal construction in accordance with the present invention in which the seal is arranged in a separate intermediate holder, which is displaceable by means of loading hoses and a spring load is provided between the intermediate holder and the seal so that the locking of the seal takes place when the intermediate holder is locked in relation to the socket proper.

FIG. 3B shows an embodiment of the present invention in which the seal 10 is arranged in an intermediate holder 18 which is displaceable by means of loading hoses 12*a*,12*b*. In a bottom portion thereof, the intermediate holder comprises a groove F, which is positioned on a guide projection E arranged on the central axis Y of the holder 11 and has a cross-sectional shape corresponding to that of the guide projection E as shown in FIG. 3A. The loading hoses 12*a* and 12*b* are placed in the grooves $U_1$,$U_2$ between the projection E and the side walls 16*a*$_1$,16*a*$_2$ of the holder 11. In a manner similar to the embodiment shown in FIG. 2, the locking means 13 of the seal 10 comprise a loading hose 14 and a locking piston 15. The locking piston 15 is pressed against a face 18*a*$_1$ of the intermediate socket 18. The loading hose 14 and the connected locking piston 15 are arranged in the groove M formed into the wall 16*a*$_1$ of the holder 11 to force the socket 18 against the wall 16*a*$_2$ of the holder 11 when pressure is applied in the loading hose 14.

In the embodiment shown in FIG. 3B, the cross-sectional profile of the seal 10 is T-shaped and a so-called flange part 10*b* of the seal 10 is situated in a backed-off groove G arranged on the top face of the intermediate holder 18. A spring J is arranged on the bottom of the groove for pressing the seal 10 by means of its flange 10*b* against the upper walls 19*a*$_1$,19*a*$_2$ above the groove G. The arrangement of an intermediate holder as in this embodiment substantially equalizes the effects of any swinging movement of the inner face of the mantle. An intermediate holder can also be utilized in any of the embodiments described herein.

Figure 3C:
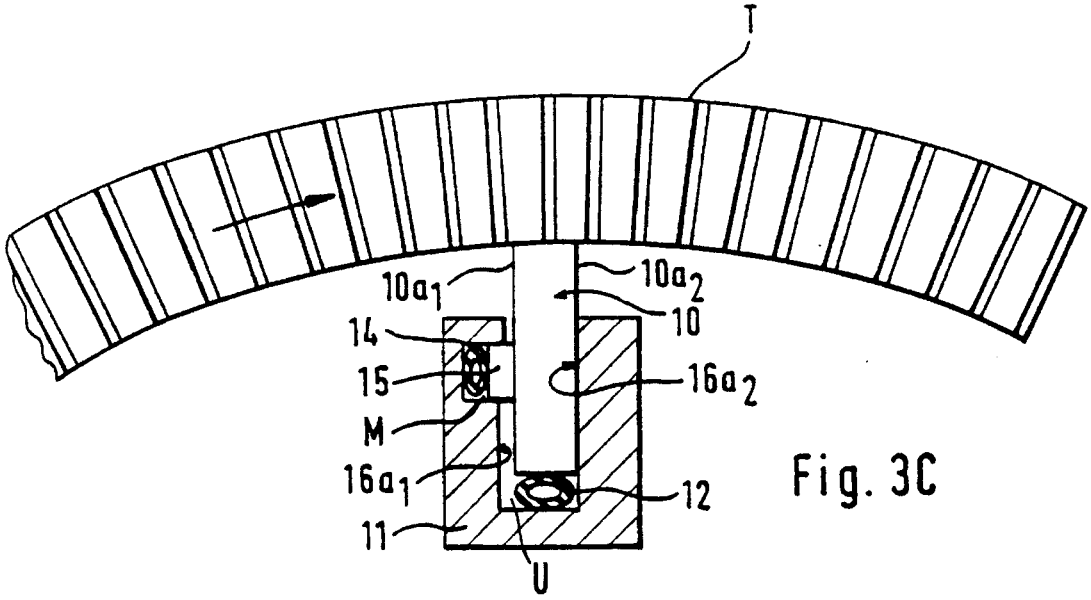
FIG. 3C shows another embodiment of the present invention which is in other respects similar to the embodiment shown in FIG. 2, except that there is only one loading hose placed on the bottom of the seal shown herein.

FIG. 3C shows an embodiment of a seal 10 in accordance with the present invention in which a loading hose 12 is arranged on the bottom of the groove U in the holder 11. The locking arrangement of the seal 10 is similar to that shown in the embodiment of FIG. 2. The seal is locked by locking means 13 in which a loading hose 14, when inflated, acts upon the locking piston 15 connected with the loading hose 14 and presses the locking piston against the side face 10*a*$_1$ of the seal 10. The other wall 10*a*$_2$ opposite to wall 10*a*$_1$ of the seal is pressed against the inner vertical face 16*a*$_2$ of the groove U in the holder 11.

Figure 3D:
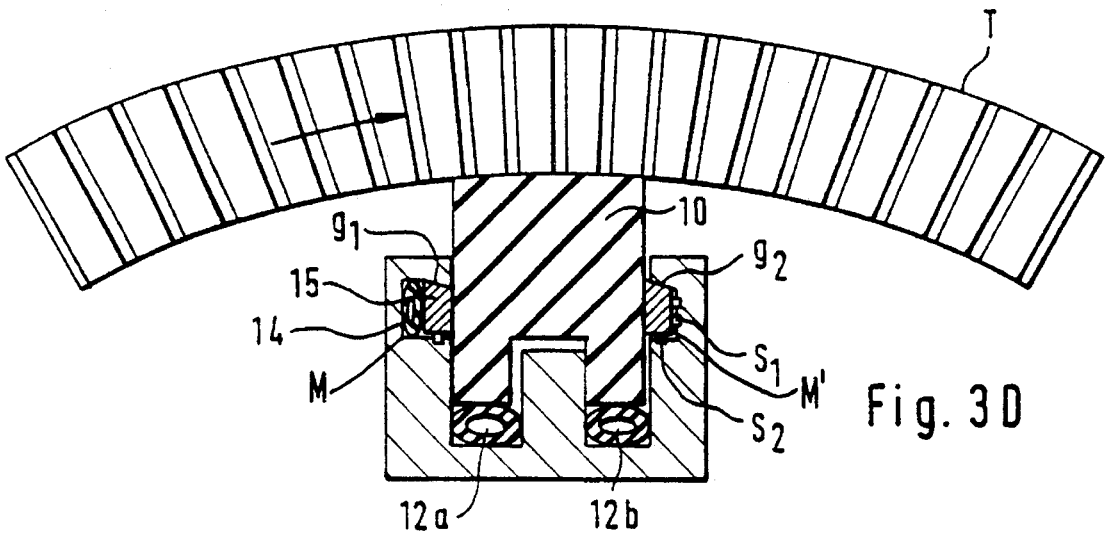
Figure 3E:
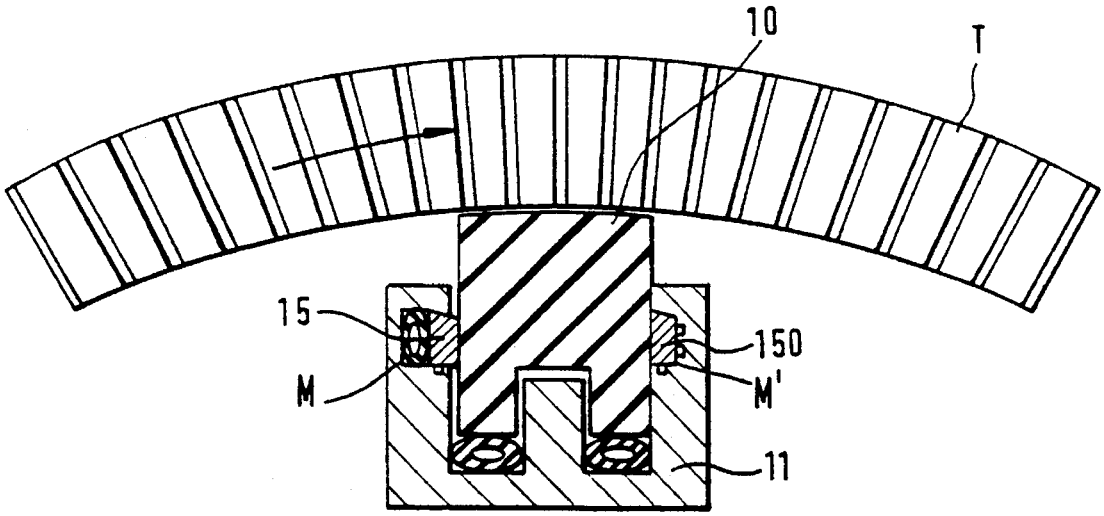

FIGS. 3D and 3E show an embodiment of the invention in which a wedge-shaped locking piston 15 is used in the sealing construction. The loading hose 14 in the groove M in the holder operates to apply a force upon the wedge-shaped loading piston 15. At an opposite side from the holder 11, in the groove M' in the holder, there is a wedge-shaped opposite locking piston 150. When the loading hose 14 is activated, the locking pistons 15,150 are displaced to the side and slightly downward by means of the wedge-shaped faces of grooves M,M' that are inclined slightly downward, compared with a horizontal plane. The locking pistons 15,150 have corresponding wedge-shaped faces. Upon inflation of hose 14, the seal 10 is pressed slightly apart from the inner face of the roll mantle. FIG. 3D illustrates a situation in which locking has not been performed whereas FIG. 3E illustrates a case in which the seal 10 is guided slightly apart from the roll mantle face by means of the wedge faces $g_1$ and $g_2$ of the locking pistons 15,150. The movement of the locking pistons 15,150 to the side and downward is permitted by allowing a certain play to remain between the faces in the grooves M,M' and the faces on the locking pistons and/or by also using resilient seal pieces $S_1$,$S_2$. . . . The wedge-shaped opposite locking piston 150 thus guides movement of the seal in a direction in which the seal is separated from the inner face of the roll mantle.

Figure 3F:
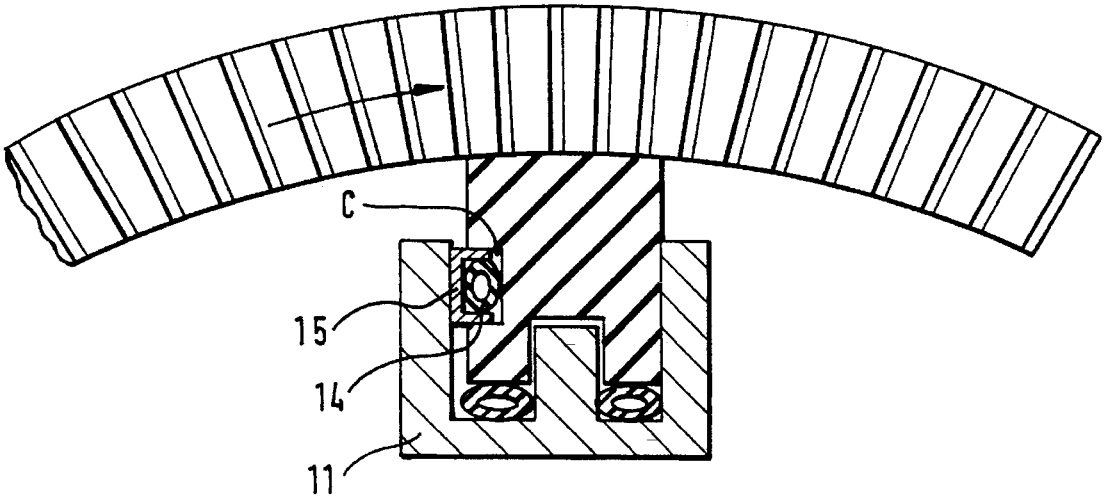
FIG. 3F shows still another embodiment of the present invention in which both a loading hose and a U-section locking piston are placed in a groove in the seal.

In FIG. 3F, an embodiment of the invention is shown in which a loading member, preferably a loading hose 14, is placed at least partially in a groove C in a side face of the seal 10, and additionally a U-section piston part 15 is arranged in the rectangular section in the groove C. The loading hose 14 is at least partly placed inside the U-section of the piston part 15. The operation of the seal in this embodiment is substantially the same as that described above.

Figure 3G:
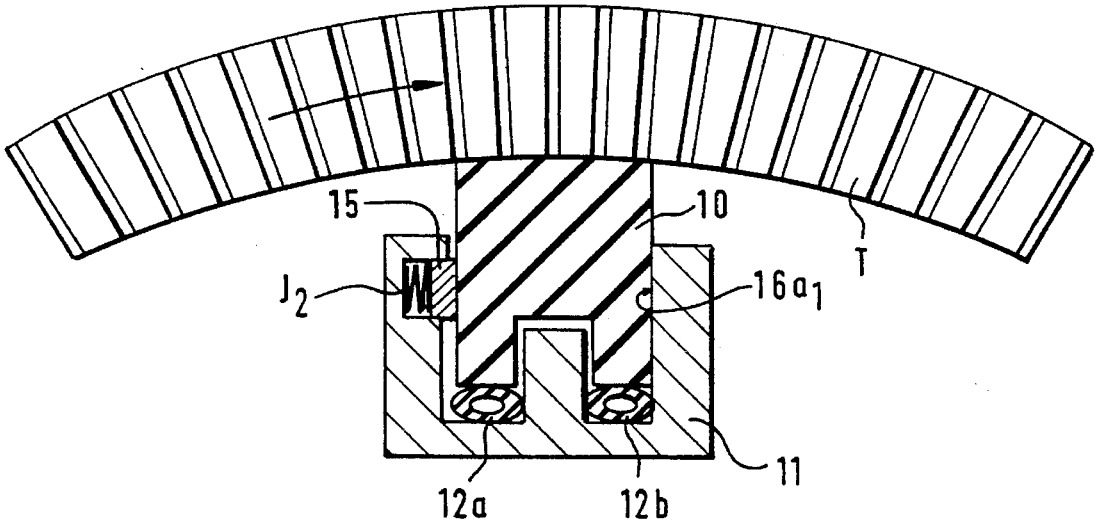
FIG. 3G shows an embodiment of the invention in which the locking is carried out by means of the spring force of a spring.

FIG. 3G shows an embodiment of the invention in which the spring $J_2$ performs the locking operation by pressing the piston 15 against the side face of the seal 10 and by thereby pressing the seal 10 against the wall face 16*a*$_1$ of the holder. The locking force of the spring $J_2$ has been dimensioned such that it does not prevent vertical movement of the seal 10 performed by means of the loading hoses 12*a* and 12*b*. However, the spring force of the spring is sufficient to keep the seal 10 against the wall face 16*a*$_1$ of the holder and against the inner face of the roll mantle after elimination of the loading pressure in the loading hoses 12*a*,12*b*.

Figure 4:
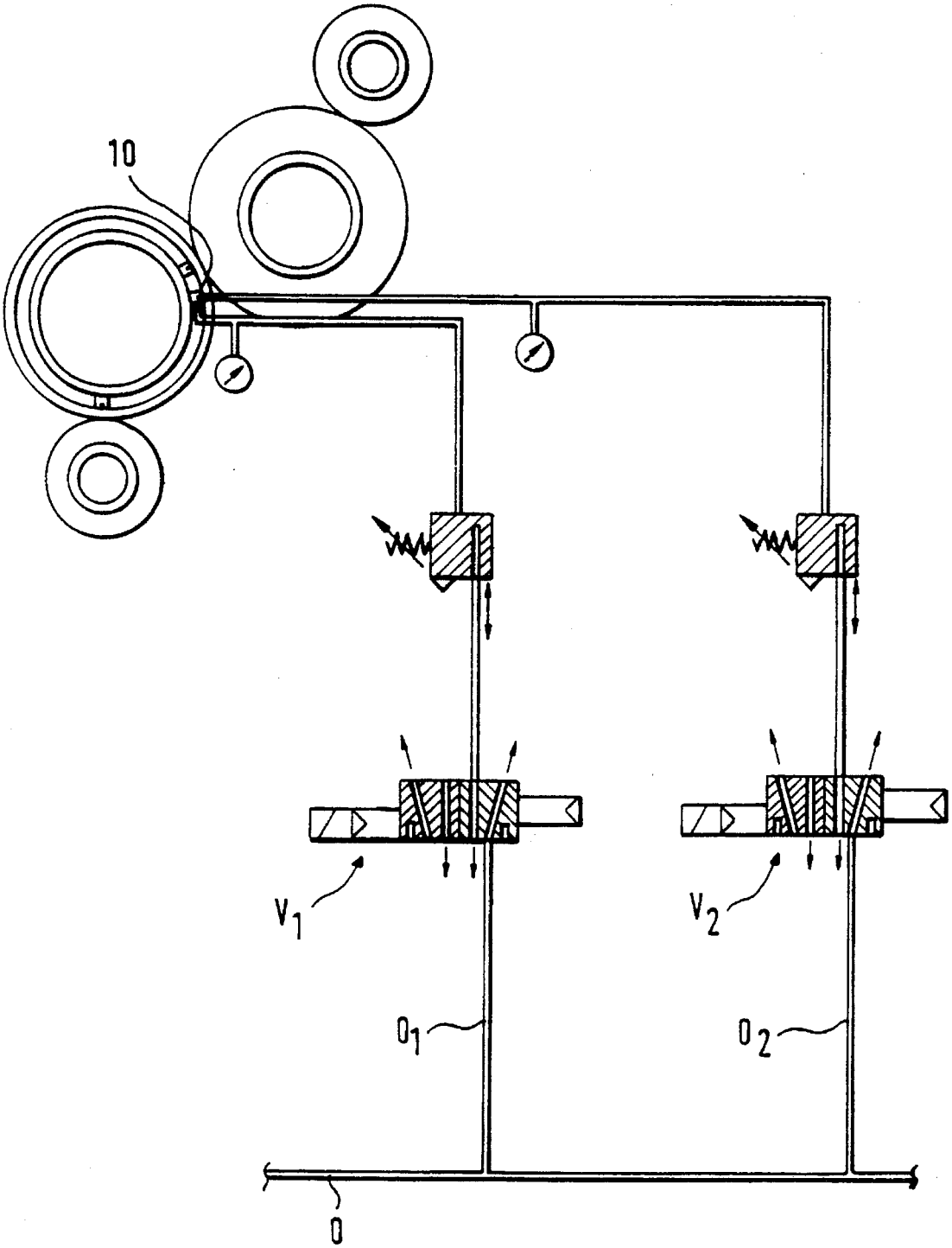
FIG. 4 shows a pneumatic diagram of the control system for the seal.

FIG. 4 shows a pneumatic diagram of the sealing operation in accordance with the present invention. Compressed air is directed out of line O and is passed into branch lines $O_1$,$O_2$ through directional valves $V_1$,$V_2$ to the seal 10. The loading of the seals 10 is controlled through the line $O_1$, and the locking of the seal 10 is controlled through the line $O_2$. In a preferred embodiment, when loading hose 14 is used as the loading means of the locking piston, line $O_1$ is connected to the loading hoses 12*a*,12*b* and line $O_2$ is connected to loading hose 14. Otherwise, if a spring or other type of loading means is used to load the locking piston, only one line of compressed air would be required, i.e., to load the seal toward the inner face of the mantle of the suction roll.

After a sufficient negative pressure has been formed in the vacuum space in the suction box, the automatic system locks the seal in its position by means of the hose-loaded locking piston. At the same time, the automatic system removes the pressure from the loading hoses of the seal, whereby the force of loading of the seal against the mantle is gradually reduced to zero and wear of the seal and the inner face of the mantle is substantially eliminated.

If the negative pressure in the suction zone is reduced, e.g., during a web break, the automatic system switches off the locking system and switches on the pressure which is directed into the loading hoses. This guarantees maintenance of the negative pressure also in situations of disturbance of the operation of the suction roll.

The examples provided above are not meant to be exclusive. Many other variations of the present invention would be obvious to those skilled in the art, and are contemplated to be within the scope of the appended claims.

I claim:

1. Sealing device for a suction box of a suction roll in a paper machine having a roll mantle, comprising:

a seal, a holder in which said seal is arranged, loading means for pressing said seal against an inner face of the roll mantle of the suction roll, and locking means arranged between said seal and said holder for fixedly locking said seal in said holder and against said inner face of said roll mantle after said seal has been pressed against said inner face of said roll mantle to allow the loading provided by said loading means to be released and to maintain said seal in pressing engagement with said inner face of said roll mantle.

2. The sealing device of claim 1, wherein said loading means comprise at least one loading hose into which a medium is supplied to pressurize said at least one loading hose.

3. The sealing device of claim 1, wherein said locking means comprise a loading hose.

4. The sealing device of claim 3, wherein said holder has a groove in a side face thereof, said loading hose being arranged in said groove.

5. The sealing device of claim 3, wherein said locking means further comprise a locking piston arranged between said loading hose and a side wall of said seal, said locking piston being pressed by said loading hose against said side wall of said seal to thereby press said seal against a first side wall of said holder.

6. The sealing device of claim 3, further comprising an intermediate holder having a groove therein and being arranged in said holder, said seal being arranged in said groove, said locking means pressing said intermediate holder against a side face of said holder, said loading hose being arranged between said intermediate holder and said holder.

7. The sealing device of claim 6, wherein said intermediate holder has a groove therein defined in part by upper walls, said seal having a flange situated in said groove, the device further comprising a spring arranged in said groove between a bottom surface of said flange and said intermediate holder, said spring pressing said flange against said upper walls.

8. The sealing device of claim 3, wherein said seal comprises a groove arranged on a side face thereof, said loading hose being arranged in said groove.

9. The sealing device of claim 1, wherein said seal comprises a groove arranged on a side face thereof and having a rectangular cross-sectional shape, said locking means comprising a locking piston and a loading hose and being situated at least partially in said groove.

10. The sealing device of claim 5, wherein said locking piston is wedge-shaped, said seal being guided slightly apart from the inner face of the roll mantle when said loading hose presses said wedge-shaped locking piston against said side wall of said seal.

11. The sealing device of claim 10, wherein said locking means are arranged in a second side wall of said holder opposite from said first side wall of said holder, the device further comprising a wedge-shaped opposite locking piston arranged between said first side wall of said holder and said seal, said wedge-shaped opposite locking piston guiding movement of said seal in a direction in which said seal is separated from the inner face of the roll mantle.

12. The sealing device of claim 1, wherein said locking means comprise a spring.

13. The sealing device of claim 12, wherein said holder has a groove therein in which said spring is arranged, said locking means further comprising a locking piston situated between said spring and said seal such that said spring presses said locking piston into contact with said seal.

14. The sealing device of claim 1, wherein said holder comprises a guide projection arranged in a bottom surface thereof on a central axis of said holder and define two grooves in said holder, said seal comprising a groove aligning with said guide projection and having a shape corresponding to the shape of said guide projection, and said loading means comprising a loading hose arranged in each of said grooves.

15. A method for sealing a vacuum space in a suction box of a suction roll in which negative pressure is produced, comprising the steps of:

arranging a seal at an edge of the vacuum space, pressing a part of said seal against an inner face of a roll mantle of the suction roll, pressing another part of said seal against an inner surface of a holder, locking said seal in said holder after the negative pressure has been generated in the vacuum space in the suction box when said seal is in pressing engagement with said inner face of said roll mantle, and releasing the pressing of said seal against said inner face of said roll mantle of the suction roll after the seal has been locked in said holder such that said seal remains in pressing engagement with said inner face of said roll mantle.

16. The method of claim 15, further comprising the steps of arranging said seal in an intermediate holder, arranging said intermediate holder in said holder, and pressing said intermediate holder against an inner surface of said holder to thereby lock said seal in said holder.

17. The method of claim 15, wherein the step of locking said seal comprises arranging a loading hose between said seal and said holder, and directing compressed air into said loading hose to load said loading hose.

18. The method of claim 16, wherein the step of locking said seal comprises arranging a loading hose between said intermediate holder and said holder.

19. The method of claim 16, further comprising arranging a spring in said intermediate holder to press said seal against the inner face of the roll mantle of the suction roll.

20. A method for sealing a vacuum space in a suction box of a suction roll in which negative pressure is produced, comprising the steps of:

arranging a seal at an edge of the vacuum space, pressing said seal against an inner face of a roll mantle of the suction roll, locking said seal in a holder after the negative pressure has been generated in the vacuum space in the suction box when said seal is in pressing engagement with said inner face of said roll mantle, arranging said seal in an intermediate holder, arranging said intermediate holder in said holder, pressing said intermediate holder against an inner surface of said holder to thereby lock said seal in said holder, wherein the step of locking said seal comprises arranging a loading hose between said intermediate holder and said holder, and releasing the pressing of said seal against said inner face of said roll mantle of the suction roll after the seal has been locked in said holder such that said seal remains in pressing engagement with said inner face of said roll mantle.

21. Sealing device for a suction box of a suction roll in a paper machine having a roll mantle, comprising:

a seal, a holder in which said seal is arranged, loading means for loading said seal, said loading means having a loaded condition and an unloaded condition such that when said loading means is in said loaded condition, said seal is pressed against an inner face of the roll mantle of the suction roll, and locking means arranged between said seal and said holder for fixedly locking said seal in said holder after said seal has been pressed against said inner face of said roll mantle to substantially prevent movement of said seal relative to said holder and to maintain said seal in pressing engagement with said inner face of said roll mantle when said loading means is in said unloaded condition.

22. Sealing device for a suction box of a suction roll in a paper machine having a roll mantle, comprising:

a seal, a holder in which said seal is arranged, loading means for pressing said seal against an inner face of the roll mantle of the suction roll, and locking means arranged between said seal and said holder for fixedly locking said seal in said holder after said seal has been pressed against said roll mantle to substantially prevent movement of said seal relative to said holder, said locking means comprising a locking piston arranged between said loading means and a side wall of said seal, said locking piston being pressed by said loading means against said side wall of said seal to thereby press said seal against a first side wall of said holder.

23. Sealing device for a suction box of a suction roll in a paper machine having a roll mantle, comprising:

a seal, a holder in which said seal is arranged, said holder comprising a guide projection arranged in a bottom surface thereof on a central axis of said holder and defining two grooves in said holder, said seal comprising a groove aligning with said guide projection and having a shape corresponding to the shape of said guide projection, loading means for pressing said seal against an inner face of the roll mantle of the suction roll, said loading means comprising a loading hose arranged in each of said grooves of said holder, and locking means arranged between said seal and said holder for fixedly locking said seal in said holder after said seal has been pressed against said roll mantle to substantially prevent movement of said seal relative to said holder.

* * * * *